US006607189B2

(12) United States Patent
Cost et al.

(10) Patent No.: US 6,607,189 B2
(45) Date of Patent: Aug. 19, 2003

(54) DOCUMENT RECYCLE AND PAYOUT DEVICE

(75) Inventors: Evan J. Cost, Audubon, PA (US); Peter Bullard, Schwenksville, PA (US)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 10/021,099

(22) Filed: Dec. 12, 2001

(65) Prior Publication Data

US 2003/0107166 A1 Jun. 12, 2003

(51) Int. Cl.[7] ..... B65H 5/22; B65H 83/00; B65H 85/00

(52) U.S. Cl. ..... 271/3.08

(58) Field of Search ..... 271/3.08; 399/373; B65H 5/22, 83/00, 85/00

(56) References Cited

U.S. PATENT DOCUMENTS 3,977,669 A 8/1976 Douno
5,302,811 A 4/1994 Fukatsu
5,553,840 A * 9/1996 Arikawa ..... 271/3.08
6,186,339 B1 2/2001 Saltsov et al.
6,199,856 B1 * 3/2001 Clauser et al. ..... 271/180
6,244,589 B1 * 6/2001 Gerlier ..... 271/177

FOREIGN PATENT DOCUMENTS

JP 61-37659 * 2/1986 ..... B65H/31/00

* cited by examiner

*Primary Examiner*—Donald P. Walsh
*Assistant Examiner*—Kenneth W Bower
(74) *Attorney, Agent, or Firm*—Fish & Richardson P.C.

(57) ABSTRACT

A document recycler combines the function of a last-in/first-out (LIFO) recycler, a payout device, and a cashbox in one unit and facilitates manual replenishing of banknotes. Storage and extraction of the documents are controlled by coordinated motions between a drive roller, a diverter, and flaps. LIFO recycling allows the device to return the same documents as inserted in case of a transaction cancellation which eliminates the need for an intermediate escrow area.

27 Claims, 11 Drawing Sheets

DOCUMENT RECYCLE AND PAYOUT DEVICE

TECHNICAL FIELD

This invention relates to an apparatus for the handling of paper documents. More specifically, the invention provides for the insertion, storage, and payout of banknotes.

BACKGROUND OF THE INVENTION

Document handling devices are well known and ubiquitous in everyday life. These handlers are most often seen in banknote handlers such as automatic teller machines (ATM), machines that can take in paper banknotes and return change, and vending machines that take paper banknotes, to name but a few. These devices are not only capable of accepting banknotes but also returning or payout of banknotes that, for example, are not determined as valid.

In order to handle paper documents devices must capable of accepting, storing, and/or payout of the documents. This process may be referred to as "recycling." Document recyclers ordinarily have different mechanisms to handle each of the steps of accepting, storing, and/or returning. Some recyclers may combine some or all of these functions into one or more modules within the document handler. Single function devices may be efficient in operation but necessarily occupy more space than combined function devices. Conversely, combined function devices, while space efficient, are not as effective as single function devices in one or more of the functions.

Some document recyclers today are constructed with a spiral storage concept. "Spiral storage" devices store documents by wrapping on cylindrical style cores. The cylindrical cores have at least three drawbacks. First, wrapping on the cores imparts a curl to the documents which makes subsequent handling more difficult as well as visually undesirable. Second, the documents have to be unwrapped. Spiral storage devices often require specialized removal apparata that makes manual replacement not possible. The process is time consuming and not easily accomplished where the document recycler is in unprotected or public places. Third, spiral storage necessarily occupies more space than documents that are stored substantially flat.

For insertion and payout, many recyclers use friction drive rollers to move the documents in and out of the unit whether the documents are stored flat or on spiral rollers. Conventional payout modules use friction feed principles to slide one note from the stack. These recyclers separate individual notes from the stack by relying on the differential friction between document and friction roller.

Further, many recyclers are not capable of returning the same document that was accepted. These recyclers may transport the documents directly storage. Payout is effected from other document storages within the document handler. Yet other recylcers use an intermediate area referred to as "escrow" to store documents prior to completion of a transaction. Canceled transactions cause return of the documents in the escrow. While this returns the documents inserted, an escrow requires additional space. Many escrow type recyclers are only capable of returning all or none of the documents in a transaction. Other escrow type recyclers may employ extra parts, such as plunger, to push the documents from within the escrow back to the user.

Consequently, there is a need for a document recycler that combines the functions of insertion, storage, and payout into one compact, space efficient device. Further, there is a need for a document recycler that does not substantially curl the documents, provides a means for manual removal of the documents, and returns all or some of the same documents inserted during a transaction.

SUMMARY OF THE INVENTION

The present invention has been developed to overcome the disadvantages and limitations of known document recyclers, including those discussed above, and to generally fulfill a need in the art for a document recycler that provides for the addition, storing, and extraction of documents. This apparatus combines the function of a last-in/first-out (LIFO) recycler, a payout device, and a cashbox in one unit and facilitates manual replenishing of documents. Addition, storage and extraction of the documents are controlled by coordinated motions between a drive roller, a diverter, and flaps.

A document is added to a document, stack by pivoting a first flap downward from an initial position to tilt the document stack to create a gap between the document stack and a drive roller. A document to be added to the stack is then inserted into the gap. Next, the first flap is rotated upward, allowing the document stack to tilt back and capture the document between the drive roller and the document stack. A second flap is then rotated downward to tilt the document stack to create a gap between the document stack and a diverter. Rotation of the drive roller transports the document so that the additional document is substantially centered over the document stack with the leading edge of the additional document resting on the second flap and the trailing edge resting on the first flap. Rotating both the first and second flaps upward away from the document stack causes the leading and trailing edges of the document to move past the flaps and rest on the document stack.

The recycler extracts a document from the stack by rotating the second flap to restrain movement of the leading edge of the documents in the document stack. The drive roller rotates to lift the trailing edge of a topmost document from the document stack. The first flap then rotates to separate the remainder of the document stack from the topmost document and the drive roller. Further rotation of the drive roller causes the topmost document trailing edge to move between the drive roller and the diverter. The diverter is then pivoted to capture the trailing edge, of the topmost document between the drive roller and the diverter. Rotating the drive roller transports the topmost document along the diverter bottom surface and away from the document stack.

It will be understood that the recycler eliminates the need for an intermediate escrow as well as a plunger commonly used in prior document recyclers. Further, because the documents are stored in a substantially flat orientation, curling of documents is minimized in comparison to recyclers employing spiral storage techniques or wrapping of stored documents on cylindrical or other curvilinear type cores. It will be appreciated that flat storage of documents also maximizes the usage of space designated for storage of the documents. A feature of the LIFO recycler is that the user is returned the same document in the case of a transaction cancellation. This features minimizes the possibility of a user inserting a fraudulent document or banknote and receiving a valid document or banknote upon cancellation of the transaction.

BRIEF DESCRIPTION OF THE DRAWINGS

An understanding of the features and advantages of the present invention will become better understood with regard to the following detailed description, appended claims, and the accompanying drawings where:

Like reference symbols in the various drawings indicate like elements.

DETAILED DESCRIPTION OF THE INVENTION

The present device provides for the addition, storing, and extraction of documents. It should be noted that the term "document" means any substantially flat item of value including, but not limited to, banknotes, bank drafts, bills, checks, tokens, coins, paper currency, security documents and any other similar objects. The apparatus combines the function of a last-in/first-out (LIFO) recycler, a payout device, and a cashbox in one unit and facilitates manual replenishing of banknotes. In this specification, the term "payout" means extraction of a document from a stack of documents.

Addition, storage and extraction of the documents are controlled by coordinated motions between a drive roller, a diverter, and flaps. The flaps are further used to move the document stack away from the entering document, as well as maintaining the appropriate drive roller pressure as described in detail below.

The stacked documents may be compressed by the flaps when there is no document being added or extracted thus reducing the space required to store the documents. During an addition of documents, LIFO recycling allows the device to return the same documents as inserted in case of a transaction cancellation which eliminates the need for an intermediate escrow area which conventional devices use to store documents until a transaction is completed.

During extraction, the shape of a pressure plate on which the documents rest causes a "longitudinal deformation" in the document. The deformation enhances the assurance that only one document is extracted because the friction between documents is less than between the documents and the drive roller. Once bent along the longitudinal axis, the single document can be reliably extracted from the stack.

Figure 1A:
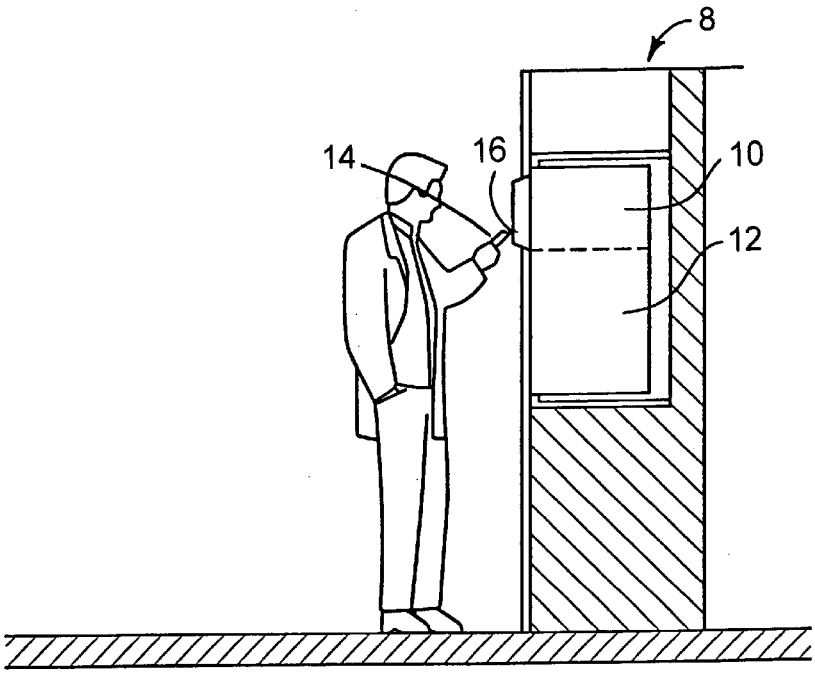
FIGS. 1A and 1B illustrate an implementation of the present invention as part of a banknote recycling apparatus.
Figure 1B:
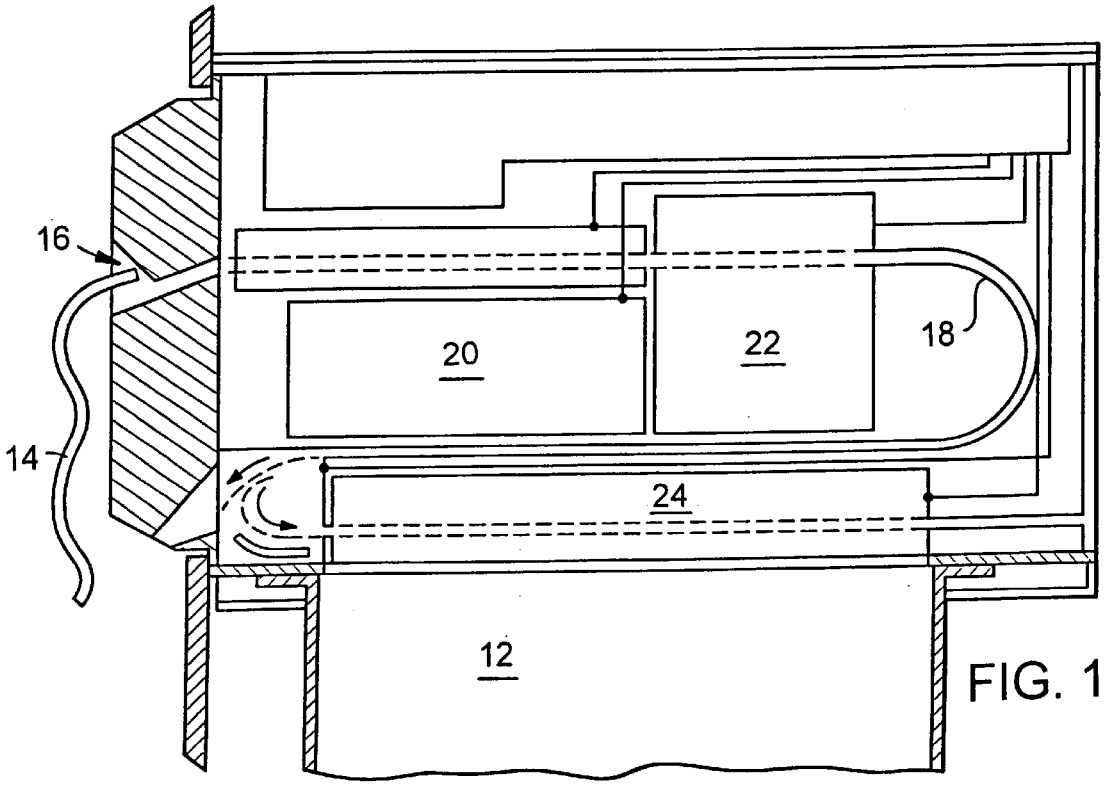

FIGS. 1A and 1B illustrate an implementation of the document recycler as part of a document handling system. The skilled reader will understand that a document recycler as disclosed herein may be used in various applications, particularly where banknotes are automatically accepted and validated such as in automated transaction machines including vending machines and banknote changing machines and the like. Referring to FIG. 1A, a banknote validating machine 10 is shown in conjunction with a cashbox 12 as part of a document handler 8. A banknote 14 may be inserted into document handling system 8 through an aperture 16 to commence a transaction.

FIG. 1B is an enlarged idealized sectional view through document handling system 8. Shown is banknote 14 being inserted into aperture 16. Banknote 14 enters a banknote passageway 18 and is transported by a transport system (not shown) controlled by a drive unit 20. Validity of the banknote is verified by a validation apparatus 22. Banknotes found to be unacceptable may be returned by reversing the transport system to feed the item back out of aperture 16, or in any of a number of other ways known to those of ordinary skill in the art. Valid banknotes are transported to a document recycler 24 so that banknote 14 may be placed onto a document stack 12 and stored. It is contemplated that document recycler 24 may be alternatively incorporated within document handler 8. For example, recycler 24 may be included as a part of validator 22 or as a part of cashbox 12.

Figure 2:
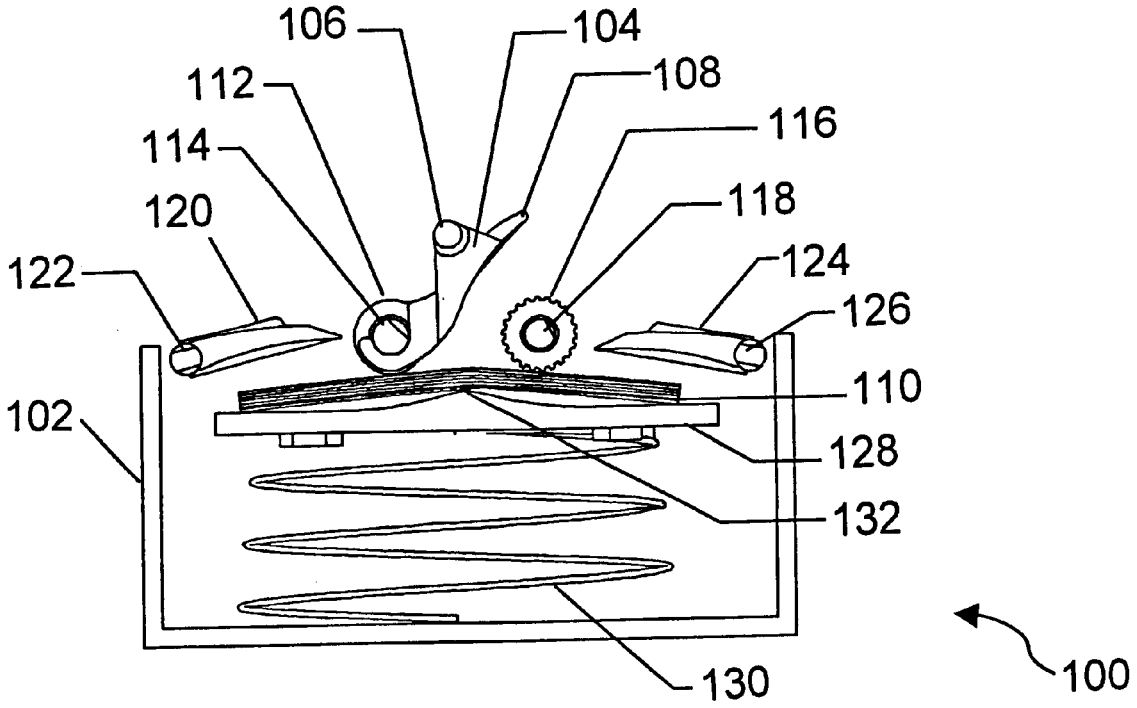
FIG. 2 is an illustration of the relationship between the elements of a document recycler according to the present invention.

FIG. 2 illustrates an implementation of a document recycler 100. A housing 102 is used for containing the elements of the recycler. Housing 102 may be made of any suitable durable material such as aluminum, steel, plastic, or a composite material or the like in a non-exhaustive list. The housing may also serve as a document storage apparatus. Further, the housing could define a cavity for the documents and may additionally be comprised of one or more security devices (not shown) well known to those of ordinary skill in the art.

A diverter 104 is attached to housing 102 at a diverter pivot 106 and is pivotable about diverter pivot 106. Diverter 104 has a diverting end 108 for guiding the documents during an extraction cycle. Documents are extracted when they are removed from a document stack 110. A diverter roller 112 is axially attached to diverter 104 and free to rotate about a diverter roller axis 114. Where elements are described herein as attached to housing 102 it is to be understood that such descriptions are for exemplary purposes only. The elements may be supported in any convenient manner, such as to a chassis or bracket, either directly or indirectly.

A drive roller 116 is axially attached to housing 102 at drive roller axis 118. Drive roller 116 may have a surface that is designed to enhance the friction with a document to provide adequate control of the document. For example, the surface may have a bumpy, abrasive, dimpled, or other such surface modifications to increase frictional forces on the documents. Additionally or alternatively, drive roller 116 may be made of, or surfaced with, a material known to increase frictional forces. Such materials include, rubber and rubber-like materials, plastics, or other materials known to those of ordinary skill in the art. In an embodiment, drive roller 116 is made of a high friction elastomer and formed to have a toothed surface profile.

A first flap 124 is attached to housing 102 at a first flap pivot point 126. A second flap 120 is attached to housing 102 by a second flap pivot point 122. Flaps 120 and 124 may be pivotable about pivot points 122 and 126 to any desired orientation. In an embodiment, flaps 122 and 124 each pivot into any of three orientations. The orientation illustrated in FIG. 1 is called the "home position." In the home position the flaps, generally, act as a guide for movement of a document on or off document stack 110. In a second position, either or both flaps 122 and 126 are pivoted downward from the home position and apply a force to document stack 110. In a third position, either or both flaps 122 and 126 are pivoted upward from the home position to allow an incoming document end to rest on document stack 110.

Documents are stored in document stack 110 which is supported by a pressure plate 128. A biasing means 130 acts on pressure plate 128 to urge document stack 110 towards rollers 112 and 116. Biasing means 130 may include mechanisms such as springs of various configurations, hydraulics, air pressure, or other such apparatus. In an embodiment, the biasing means is a spring. Pressure plate 128 is free to tilt on biasing means 130 in response to pressure applied by flaps 122 and 126. Further, pressure plate 128 is formed to have a raised center portion in contact with document stack 110.

Figure 3A:
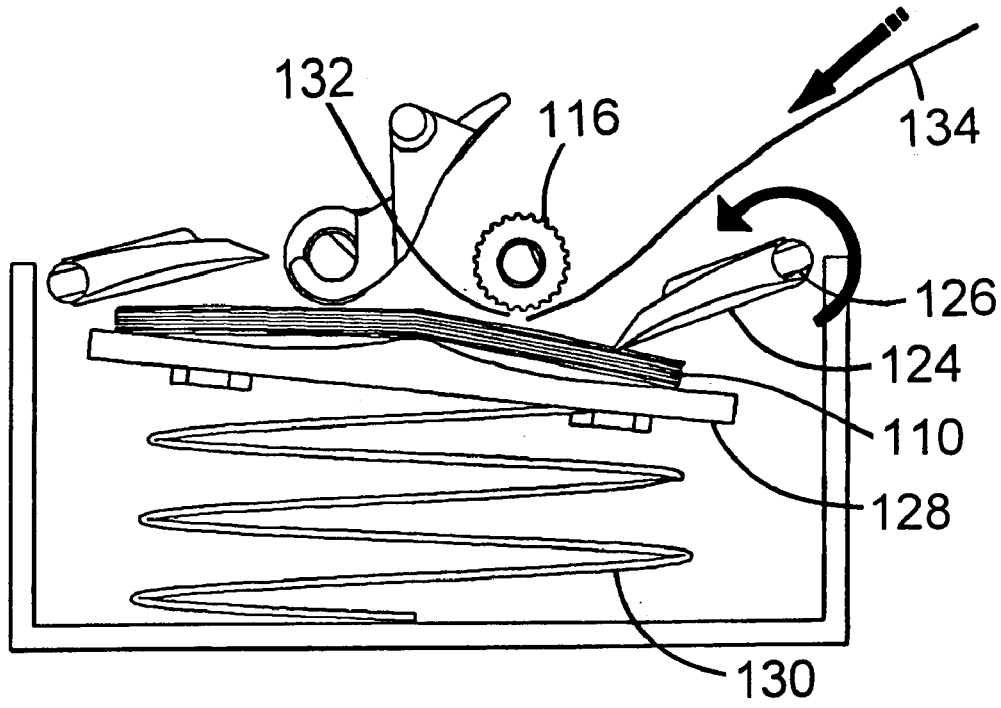
FIG. 3A to FIG. 3G illustrate a method of adding a document to a document stack in accordance with an implementation of the present invention.

FIGS. 3A–3G illustrate the operation of the recycler device of FIG. 2 to add a document to document stack 110. Referring to FIG. 3A, first flap 124 pivots on first flap pivot point 126 from the home position towards document stack 110, into a second position, exerting a force on one end of document stack 110. The force is communicated through document stack 110 to a first end of pressure plate 128 causing pressure plate 128 to rotationally deflect, that is tilt, away from drive roller 116 and act against biasing means 130. The tilting of pressure plate 128 creates a gap 132 between document stack 110 and drive roller 116. A longitudinal edge of document 134 is caused to enter this gap by a document transporter which is not part of the present invention. Document transporters are commonly known to those of ordinary skill in the art. Entry of the longitudinal edge of document 134.

Figure 3B:
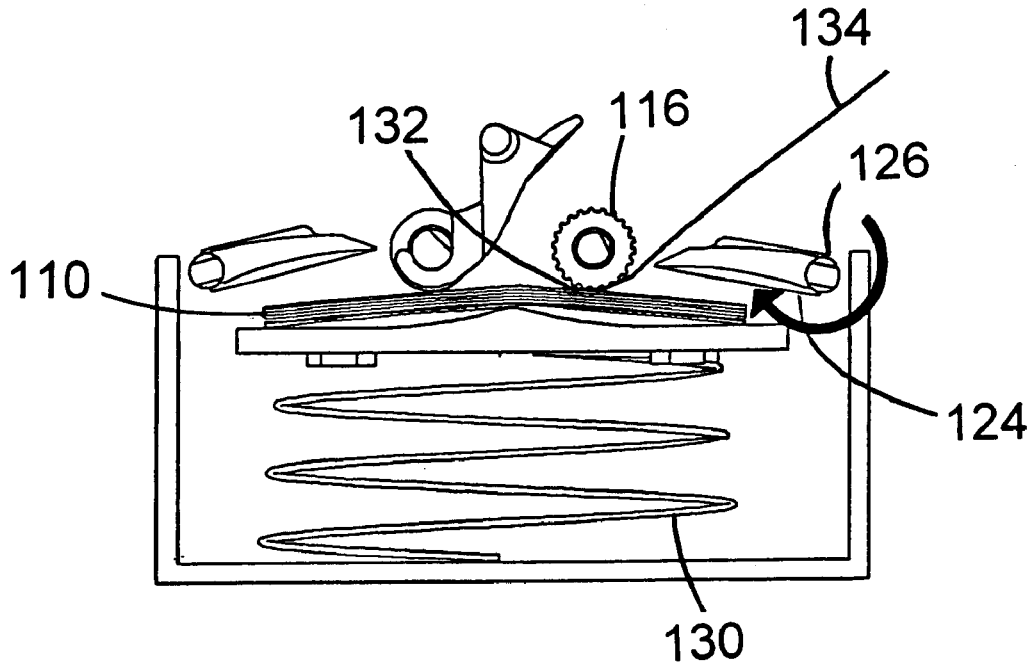

FIG. 3B illustrates the document addition operation wherein first flap 124 pivots on first flap pivot point 126 to the home position removing the force acting against biasing means 130. Biasing means 130 acts on pressure plate 124 and document stack 110 causing closure of gap 132 and capture of document 134 between document stack 110 and drive roller 116.

Figure 3C:
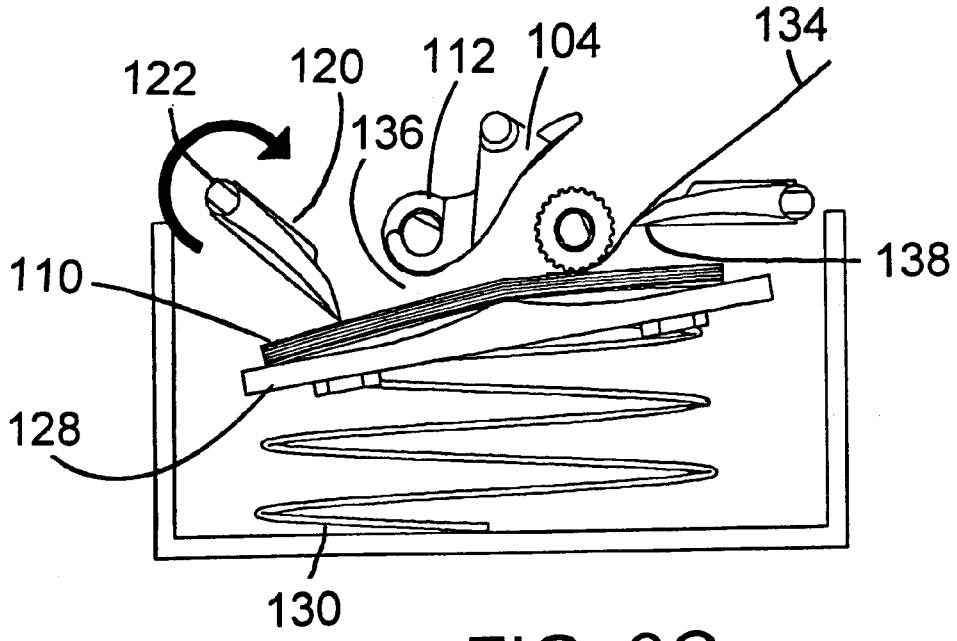
Figure 3D:
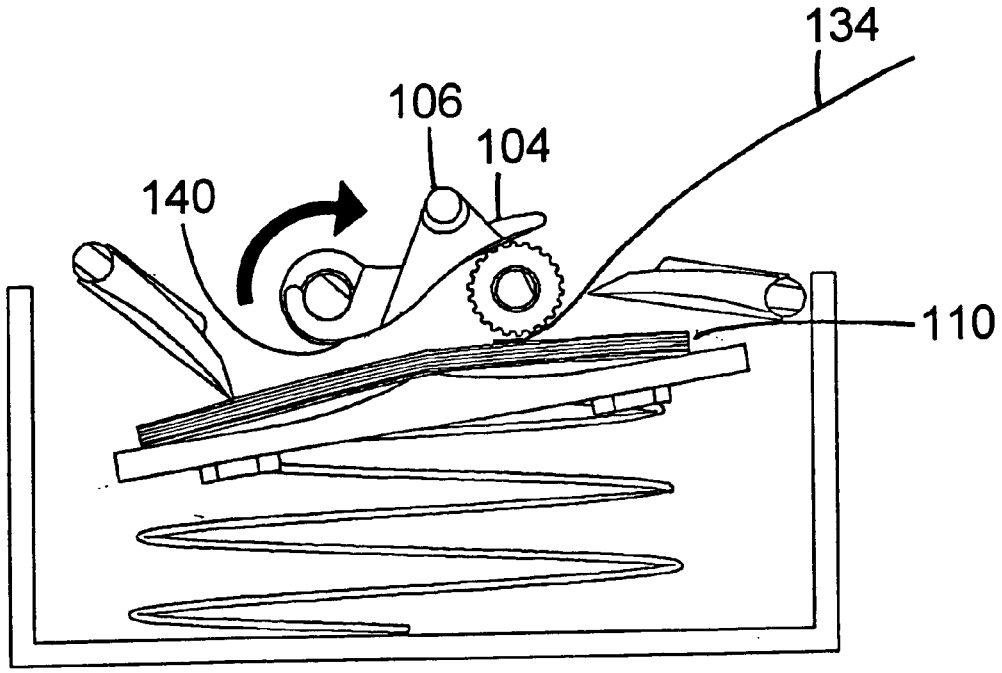

Referring to FIG. 3C, second flap 120 pivots on second flap pivot point 122 from the home position towards document stack 110, into a second position, exerting a force on a second end of document stack 110. The force is communicated through document stack 110 to a second end of pressure plate 128 causing pressure plate 128 to tilt away from diverter roller 112 and act against biasing means 130. The tilting of pressure plate 128 creates a gap 136 between document stack 110 and diverter roller 112. Referring to FIG. 3D, diverter 104 pivots on diverter pivot 106 so that a diverter underside 140 is positioned to guide document 134 onto document stack 110.

Figure 3E:
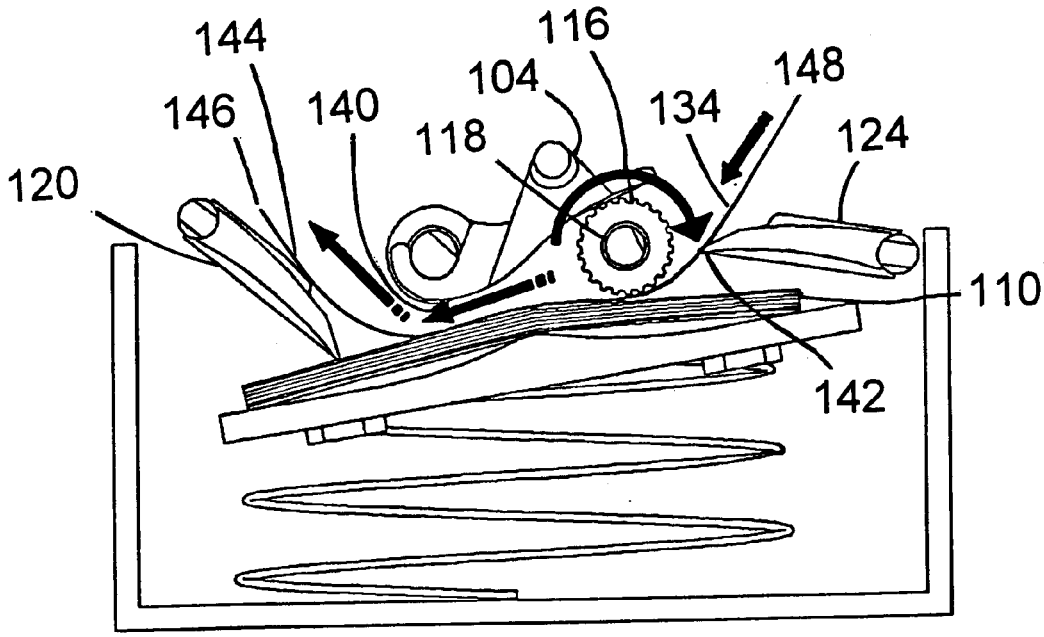

Referring to FIG. 3E, drive roller 116 rotates on drive roller axis 118 causing captured document 134 to move across document stack 110. In a preferred embodiment, a first flap edge 142 is shaped to aid in guiding document 134 under drive roller 116 as the document moves across document stack 110. As described herein above, drive roller 116 is constructed so that the friction between drive roller 116 and document 134 is greater than the friction between document 134 and document stack 110. This frictional relationship enhances the transport of the document across the document stack while decreasing the likelihood that documents already on the stack will be disturbed. Underside 140 of diverter 104 acts as a guide to document 134 as the document travels across the document stack. Drive roller 116 continues to rotate causing the movement of document 134 across document stack 110. Guided by underside 140 of diverter roller 112, a leading edge 146 of document 134 is guided onto second flap top surface 144. Drive roller 116 ceases rotation when document 134 is centered on document stack 110 with document leading edge 146 on second flap 120 and document 134 trailing edge 148 on first flap 124.

Figure 3F:
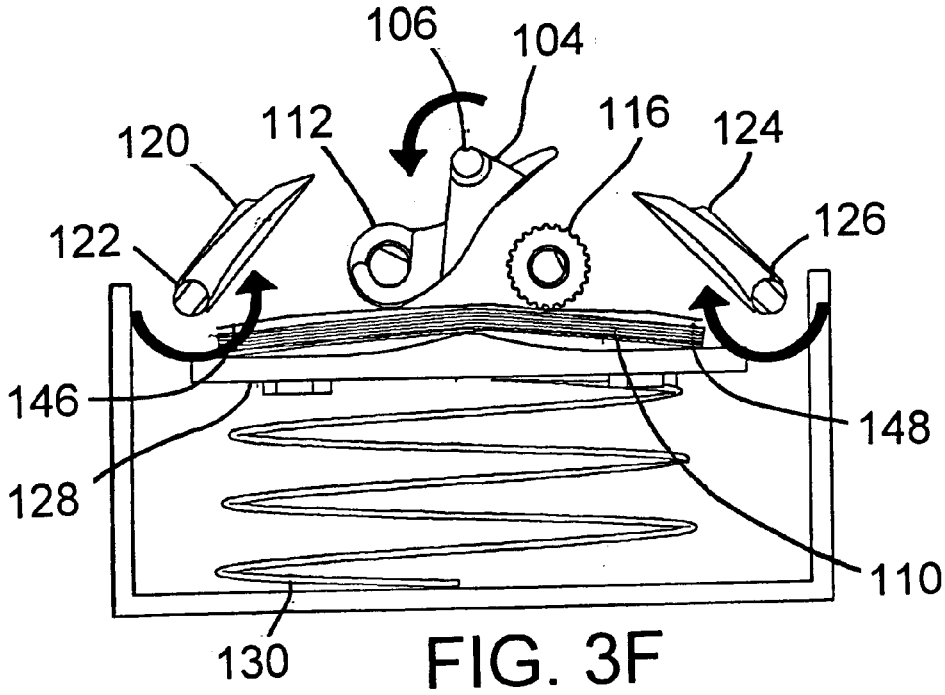
Figure 3G:
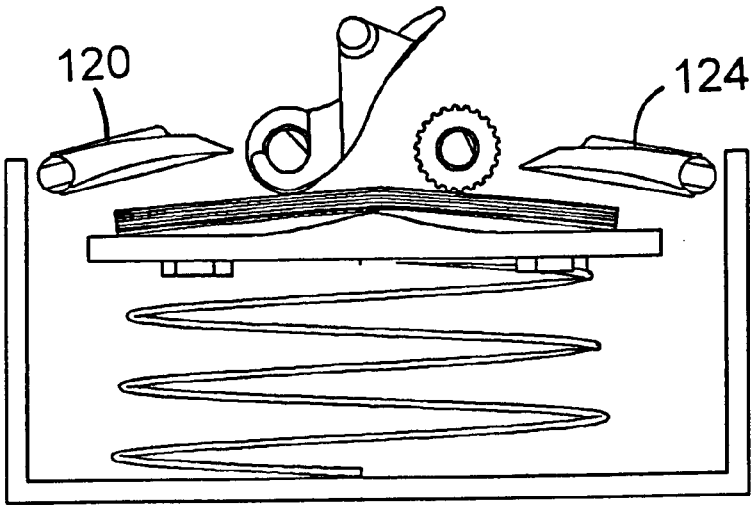

Referring to FIG. 3F, once document 134 is centered over the document stack as described, flaps 120 and 126 pivot upward, to a third position, allowing document edges 146 and 148 to move past the flaps and rest on document stack 110. Pivoting of second flap 120 also removes the force acting against biasing means 130 that had caused tilting of document stack 110 and pressure plate 128. In a preferred embodiment, diverter 104 pivots on diverter pivot 106 to bring diverter roller 112 in contact with document stack 110 so that both rollers 112 and 116 act to compress the stack. Referring to FIG. 3G, flaps 120 and 124 pivot back to the home position in preparation for another addition cycle as above or extraction cycle as described herein below. It is also contemplated that flaps 120 and 124 may have a home position such that the flaps contact document'stack 110 and aid in keeping documents in the stack compressed.

FIGS. 4A–4G illustrate the process for extracting a document from the document stack. The extraction of a document may commence from any position during or after completion of the addition cycle of a document. Thus, a user of the document recycler of the present invention may cancel the addition of a document, or documents, at any time. It is contemplated that control logic of a document handler employing the recycler may be designed to either enable or inhibit cancellation of a document addition cycle. Further, it is also contemplated that control logic may enable or inhibit extraction of documents already added to the document stack. Because of the last-in/first-out feature, the user will receive back the very same documents that the user entered into the document handler. This features minimizes the possibility of a user inserting a fraudulent document or banknote and receiving a valid document or banknote upon cancellation of the transaction. It is also contemplated that control logic may enable the return of documents from the stack beyond those included in the user's current transaction. Other transaction control logic may be implemented without detracting from the novel implementation of the document recycler of the present invention.

Figure 4A:
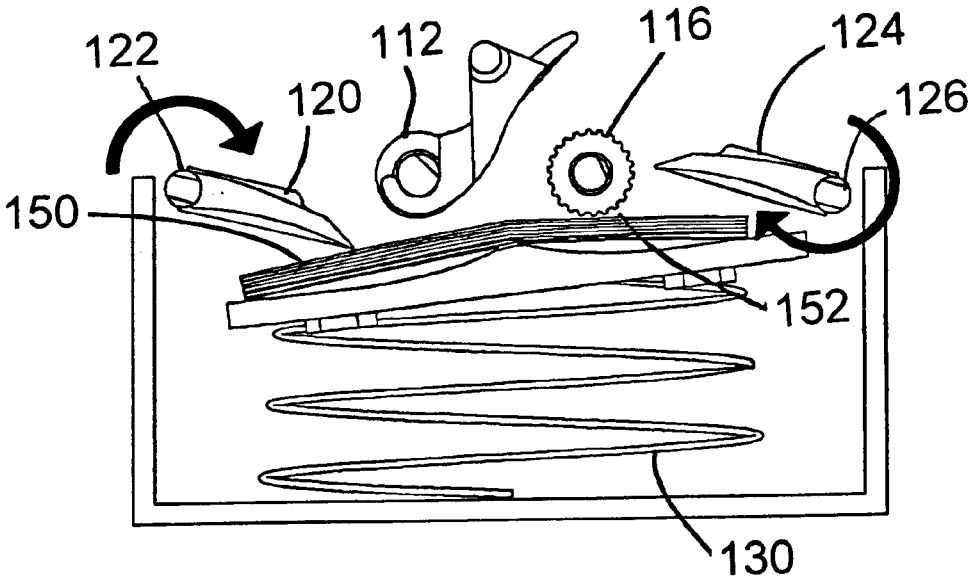
FIG. 4A to FIG. 4G illustrate a method of extracting a document from a document stack in accordance with an implementation of the present invention.

In FIG. 4A, first flap 124 pivots around first flap pivot point 126 to the home position. Second flap 120 pivots around second flap pivot point 122 towards document stack 110 into second position, exerting a force on the second end 146 of document stack 110 and restraining second edge 146 of the topmost document of document stack 110. The force applied by second flap 120 is communicated through document stack 110 to the second end of pressure plate 128 causing pressure plate 128 to tilt document stack second end 150 away from diverter roller 112 and bring document stack first end 152 in contact with drive roller 116.

Figure 4B:
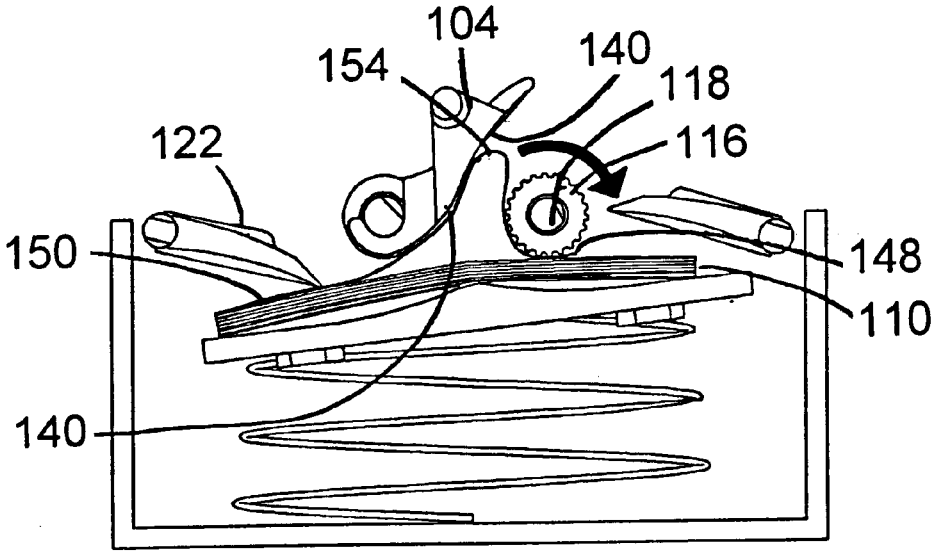

Referring to FIG. 4B, drive roller 116 rotates around drive roller axis 118 causing trailing edge 148 of topmost document on stack 110 to move towards diverter 104. Because document second edge 150 is restrained from moving, the movement of document trailing edge 148 results in bunching of the document due to the sideways loading of the document in compression along diverter underside 140 thus forming a "wave" 154 in the document.

Figure 4C:
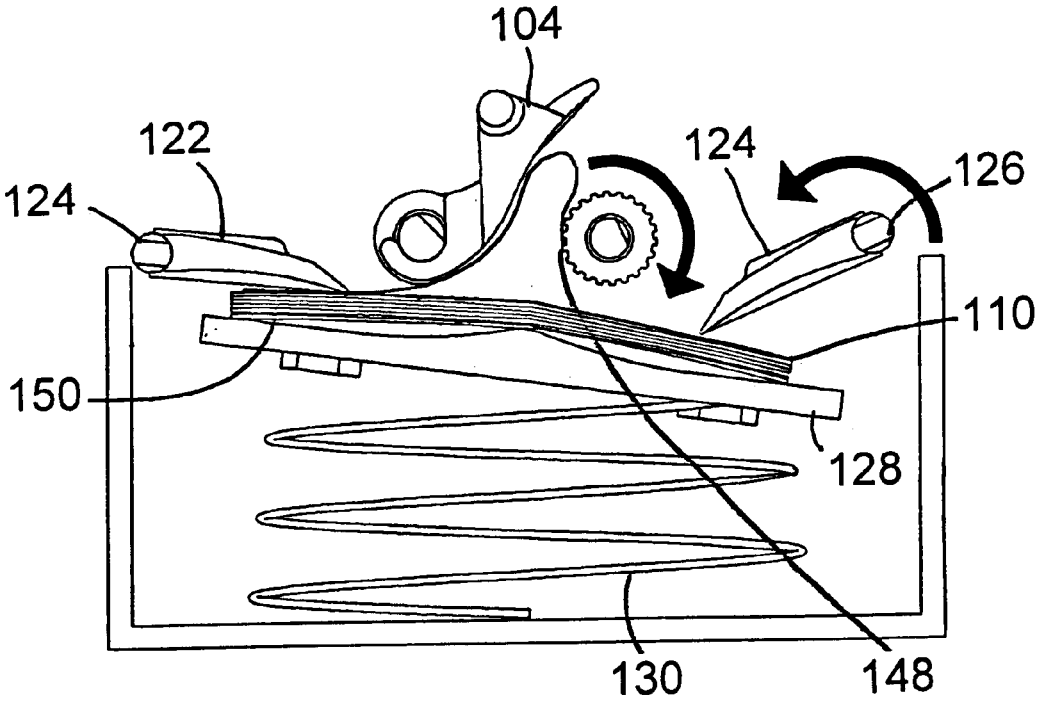

Drive roller 116 continues to rotate and move the topmost document trailing edge 148 towards diverter 104 until trailing edge 148 is beyond the tangent point between drive roller 116 and document stack 110. Referring to FIG. 4C, second flap 120 the pivots to the home position and first flap 124 pivots toward document stack 110 into second position.

Figure 4D:
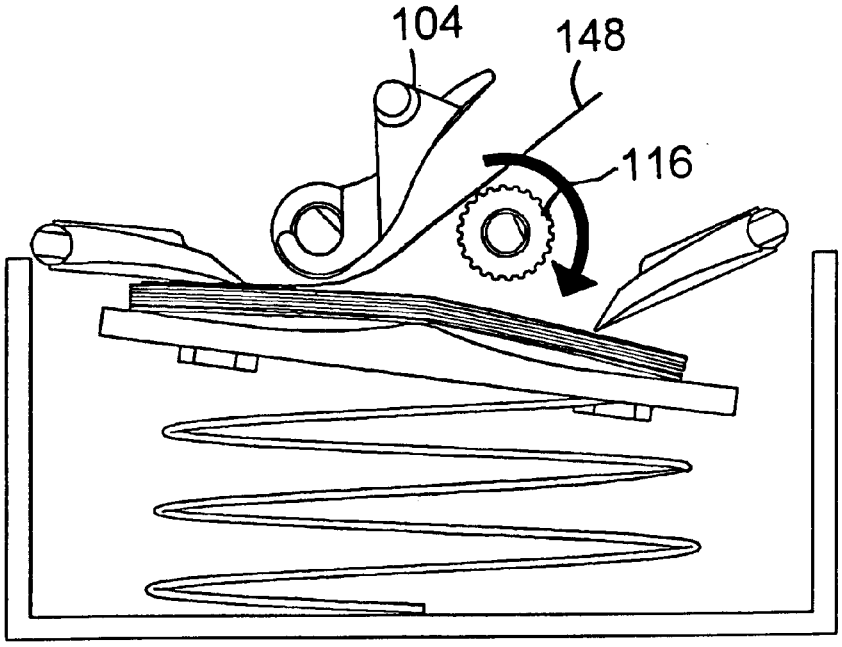

The pivoting of first flap 124 exerts a force on one end of document stack 110. The force is communicated through document stack 110 to the first end of pressure plate 128 causing pressure plate 128 to tilt away from drive roller 116 removing the pressure between drive roller 116 and document stack 110 and thus preventing the pick-up of additional documents from the stack. Tilting of pressure plate 128 also causes document stack 110 second end 150 to remain restrained by second flap 122. As illustrated in FIG. 4D, further rotation of drive roller 116 moves document trailing edge 148 between drive roller 116 and diverter 104. It should be noted that the topmost document is stiffer in compression along the longitudinal axis than across the width. This enhances the springing back of the document trailing edge when that edge traverses past drive roller 116. In a preferred embodiment a drive roller having a toothed profile or other surface relief may aid in the movement of the document trailing edge between drive roller 116 and diverter 104.

Figure 4E:
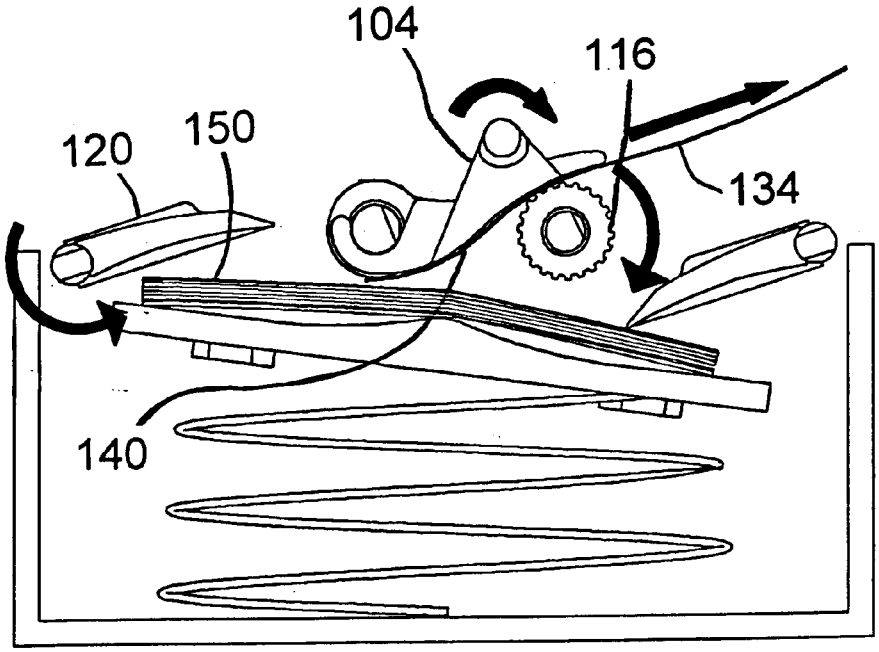

Referring to FIG. 4E, second flap 120 pivots to the third position away from document stack 110 second end 150 and releasing the restraint on topmost document 134. Diverter 104 pivots to pinch document 134 between diverter underside 140 and drive roller 116. Continued rotation of drive roller 116 moves topmost document 134 along underside of diverter 140 due to the frictional forces between drive roller 116 and document 134.

Figure 4F:
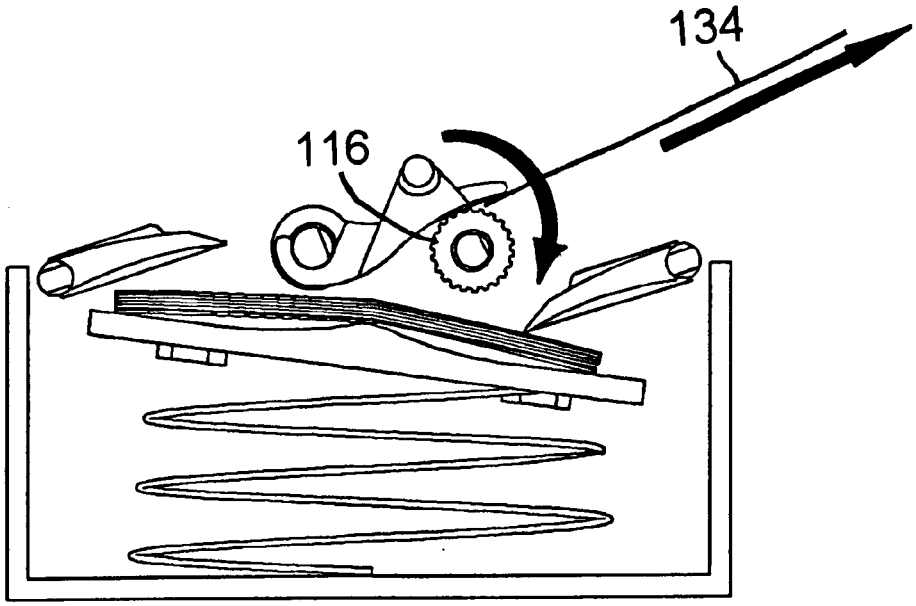

FIG. 4F illustrates the continuation of rotation of drive roller 116 to extract document 134 making the document available to the document transport system, not shown and not part of the present invention. It is contemplated that the transport system may be capable of transporting the extracted document for return to the user or other extraction destination.

Figure 4G:
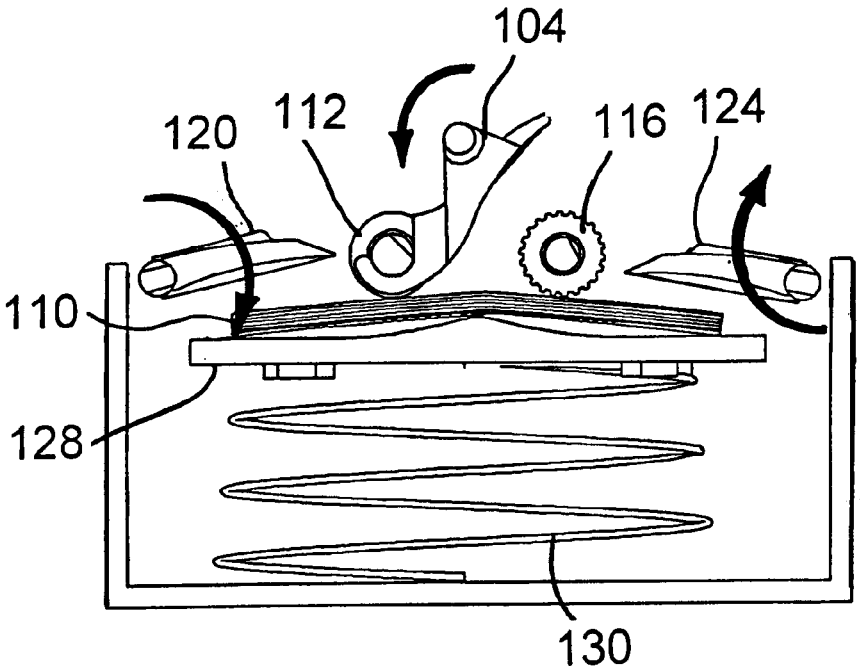

Referring to FIG. 4G, the document recycler of the present invention is returned to a position preparatory to addition or extraction of another document. Flaps 120 and 124 return to the home position. Return of the flaps to the home positions removes flap pressure on document stack 110 and pressure plate 128. Diverter 104 pivots towards document stack 110. Biasing means 130 acts on pressure plate 128,urging document stack 110 into contact with rollers 112 and 116. It is contemplated that flaps 120 and 124 may be pivoted into their second positions to aid in compression of document stack 110.

Figure 5:
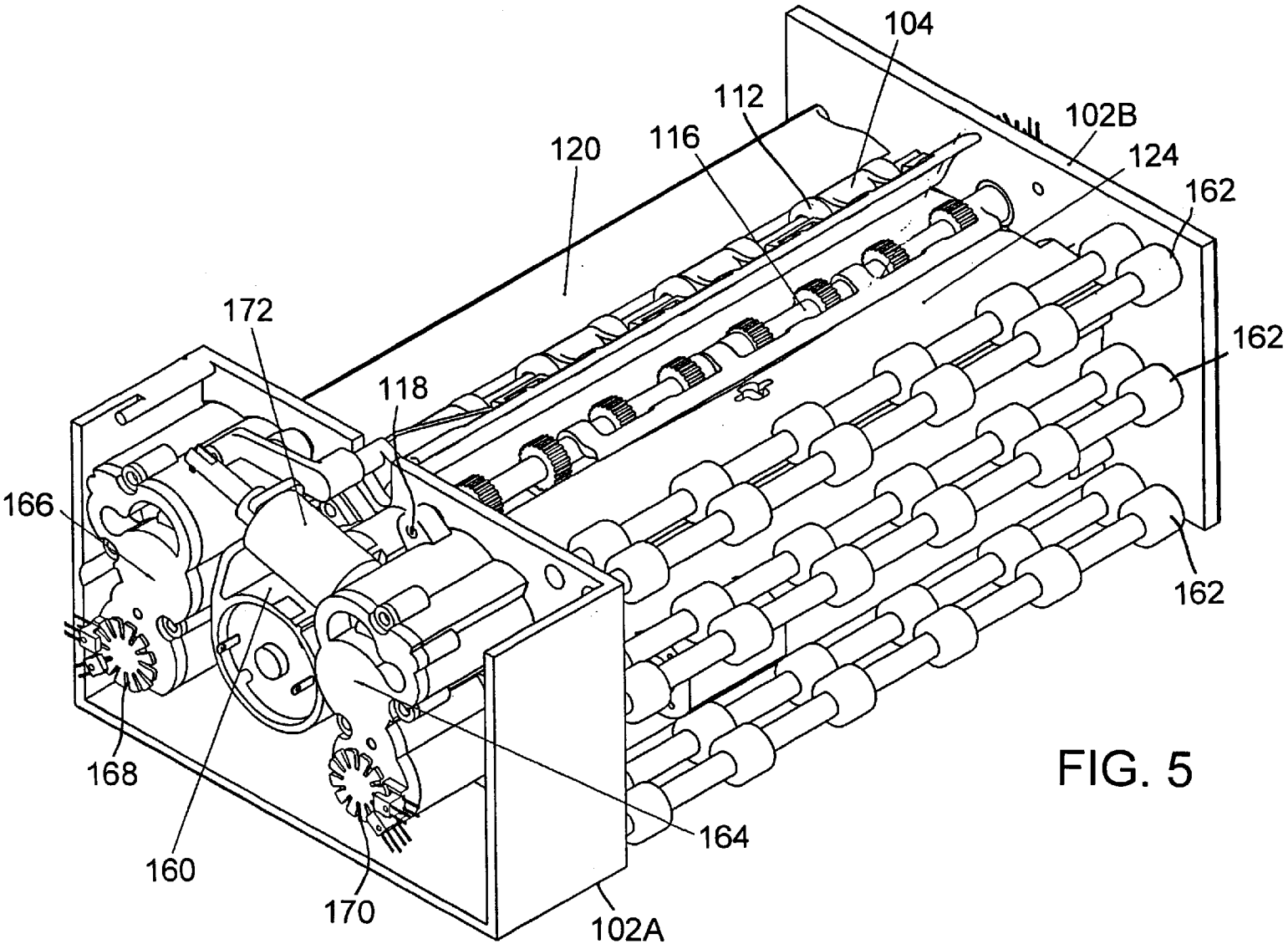
FIG. 5 is an illustration of an embodiment of the present invention.

FIG. 5 is a cutaway illustration of an embodiment of the present invention. Transport rollers 162, which do not form a part of the document recycler, transport a document into or away from the recycler. First flap 118, diverter 104, diverter roller 112, and second flap 120 are illustrated assembled into housing 102A, 102B. It should be noted that, in this implementation, drive roller 116 includes more than one roller mounted on the same axis 124. In a like manner, diverter 104 may be comprised of more than one diverter roller 112, as shown. In the illustrated embodiment, three separate motors, 160, 168, and 170 are employed to drive the motion of first flap 124, drive roller. 16, and second flap 120 respectively. The motor drives may employ intermediate gearing arrangements 172, 166, and 164. It is also contemplated that a single motor may accomplish the drive functions. Document handler decisional logic circuitry such as a microprocessor may be employed to direct a single or multiple motor arrangement to transfer rotational power to the appropriate recycler element in the appropriate sequence. The direction of the rotational power may be through such commonly known devices as mechanical linkages or electro-mechanical solenoids. It is further contemplated that the driver for the transport system may be employed to also drive the motion of the recycler elements.

Figure 6:
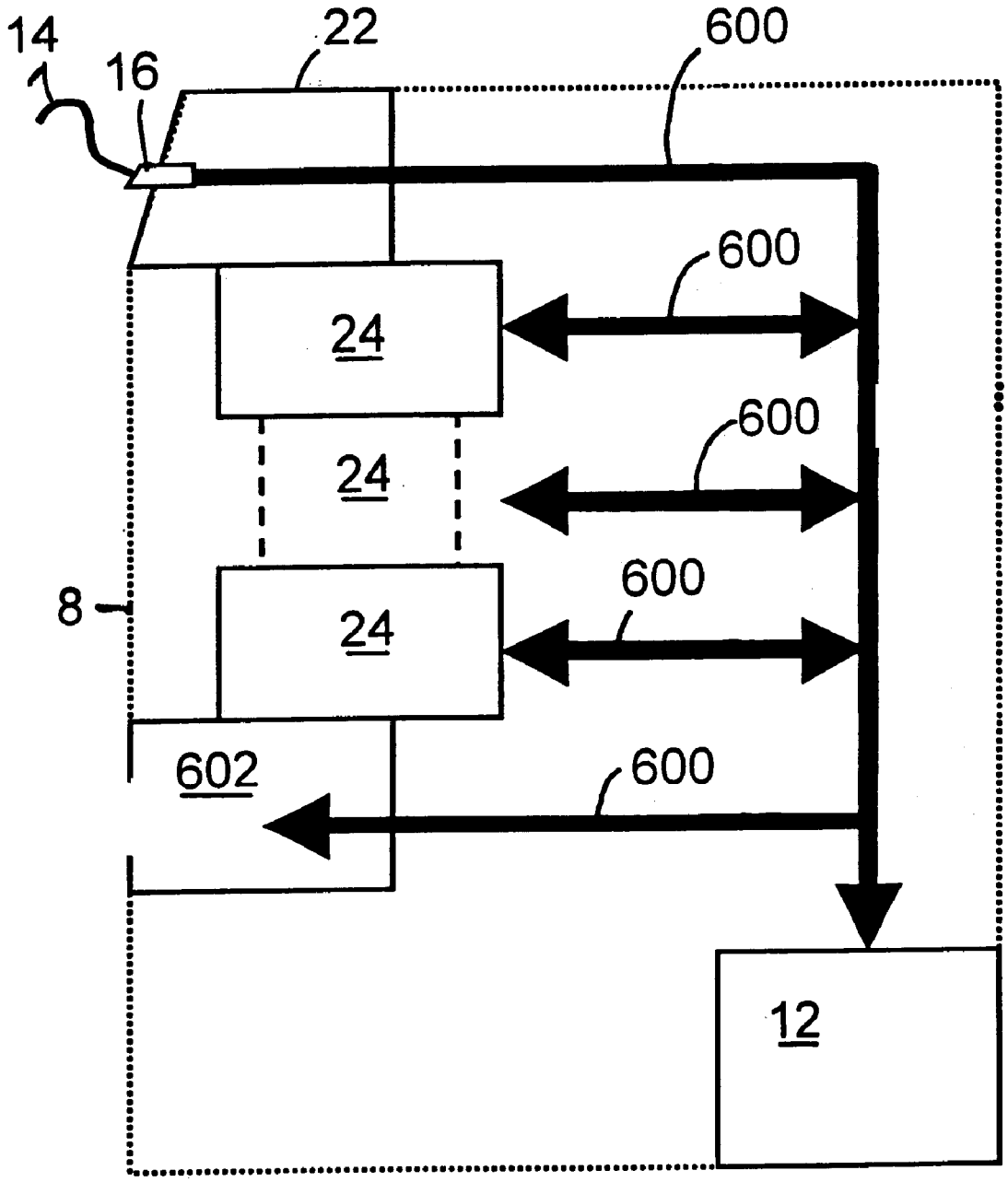
FIG. 6 is an alternative embodiment of the invention comprising multiple document recyclers.

FIG. 6 illustrates a banknote handling system 8 employing a plurality of document recyclers 24. Banknote 14 enters banknote handler 8 through an aperture 16. A transport system 600 transports the banknote through a validator 22. Validators and transport systems are known to those of ordinary skill in the art. Validator 22 is configured to determine at least the validity of a banknote and the monetary denomination of the banknote.

The document handler has logic controls (not shown), such as a microprocessor, that receive banknote characteristics from validator 22 and controls transport system 600 so that banknotes may be transported to any one of the plurality of recyclers 24.

The validation/transport system of the document handler may be used to distinguish between various types of documents and, based upon that distinction, direct those documents to a specific recycler. Banknotes may be stored by denomination value, size, issuing agency, country of origin, or any other characteristic. In an exemplary embodiment of a banknote recycler, the validator may determine the denomination of the note. The transport system could then transport notes of the same denomination to one of the plurality of recyclers. In this way the document recycler not only keeps notes sorted by denomination but also allows the document handler to make change of larger banknotes by enabling extraction of specific banknote denominations from the plurality of recyclers.

The banknote handler logic controller determines which, if any, banknotes should be recycled. Recycling occurs, for example in a non-exhaustive list, when a transaction is canceled, banknotes are transferred into another currency, banknotes are exchanged for coupons, banknotes are exchanged for more banknotes of a smaller denomination or fewer banknotes of a larger denomination.

Recycled banknotes are transported by transporter 600 to a recycle bin 602 where it is accessible to a user of the banknote handler. In an alternative embodiment a recycle bin is not used. Recycled banknotes may be transported by transporter 600 back through aperture 16.

Banknotes may alternatively be transported to a cashbox 12. It is contemplated that there may be a plurality of cashboxes. These may serve, in a non-exhaustive list of possibilities, for storage of banknotes that exceed the capacity of a recycler, that are determined by the validator as counterfeit or otherwise non-returnable, or of a type, denomination, or kind for which a recycler is not provided.

It will be understood that complex validators may distinguish not only between denominations of banknotes but between currencies of foreign nations. Thus the banknote handler may additionally provide for exchange between alternative currencies by accepting banknotes of one currency and recycling notes from another currency. In a similar manner, it is also anticipated the recycler may exchange banknotes for coupons or other documents.

It is further contemplated that banknotes could be accepted in exchange for goods and/or services and recycle change from an overpayment. In a particular embodiment, a consumer may purchase goods from a store and the price is transmitted to the document handler. The consumer may then enter banknotes in payment and the recycler returns change.

A number of embodiments of the invention have been described. Nevertheless, it will be understood that various modifications may be made without departing from the spirit and scope of the invention. Accordingly, other embodiments are within the scope of the following claims.

What is claimed is:

1. A document recycler comprising:

a chassis;

a diverter rotatably coupled to the chassis;

a drive roller rotatably coupled to the chassis;

a pressure plate;

a first pivotable flap coupled to a first side of the chassis; and a second pivotable flap coupled to a second side of the chassis, wherein the first and second flaps, the diverter, and the drive roller are operable in a predefined sequence to stack documents on the pressure plate and to recycle documents off the stack.

2. The apparatus of claim 1 further comprising a biasing means situated between the chassis and the pressure plate to bias the pressure plate towards the drive roller and the diverter.

3. The apparatus of claim 2 wherein the biasing means is a spring.

4. The apparatus of claim 1 wherein the pressure plate is capable of rotational deflection.

5. The apparatus of claim 4 wherein the pressure plate further comprises a stack deformer to effect a bend in the document stack.

6. The apparatus of claim 5 wherein the bend effected in the document stack is longitudinal to the stack.

7. The apparatus of claim 1 further comprising a drive roller surface that provides a frictional force to the document that is greater than the frictional force between the document and the document stack.

8. The apparatus of claim 7 wherein the drive roller surface is a high friction elastomer.

9. The apparatus of claim 7 wherein the drive roller has a friction enhancing surface profile.

10. The apparatus of claim 9 wherein the friction enhancing surface profile is toothed.

11. A document recycler comprising:

a chassis;

a diverter, coupled to the chassis and rotatable about a first pivot and having a diverting end and a roller end;

a diverter roller axially coupled to the roller end and operable to roll about a diverter roller axis;

a drive roller, coupled to the chassis, rotatable about a drive roller axis;

a pressure plate to support a document stack;

a biasing means associated with the pressure plate for urging the pressure plate towards the diverter roller and the drive roller and for allowing tilting of the plate;

a pivotable first flap, coupled to the chassis, having a first position for applying pressure to a first end of the document stack and a second position for guiding the documents through the document recycler; and a pivotable second flap, coupled to the chassis, having a first position for applying pressure to a second end of the document stack and a second position for guiding the documents through the document recycler.

12. The apparatus of claim 11 wherein the pressure plate further comprises a stack deformer to effect a bend in the document stack.

13. The apparatus of claim 12 wherein the bend effected in the document stack is longitudinal to the stack.

14. The apparatus of claim 11 further comprising a drive roller surface that provides a frictional force to the document that is greater than the frictional force between the document and the document stack.

15. The apparatus of claim 14 wherein the drive roller surface is a high friction elastomer.

16. The apparatus of claim 14 wherein the drive roller has a friction enhancing surface profile.

17. The apparatus of claim 14 wherein the drive roller has a toothed drive surface.

18. A method comprising:

rotating a first flap to separate a document stack first edge from a drive roller;

inserting a document leading edge between the document stack first edge and the drive roller;

rotating the drive roller to transport the document over the document stack; and rotating the first flap and a second flap away from the document stack to allow the additional document to repose on the document stack.

19. The method of claim 18 further comprising rotating the first and second flaps downward to hold the document stack edges in place.

20. The method of claim 18 further comprising applying a biasing force to the document stack.

21. The method of claim 20 wherein the upward biasing force comprises applying pressure to the document stack on the side opposite the drive roller and the diverter roller.

22. The method of claim 18 further comprising supporting the documents stack with a rotationally deflectable pressure plate.

23. The method of claim 18 wherein inserting the document further comprises:

rotating the first flap away from the document stack; and rotationally deflecting the document stack so that the stack presses the additional document against the drive roller.

24. The method of claim 18 wherein a diverter assembly acts as a guide for the documents.

25. A method comprising:

rotating a flap to restrain movement of a leading edge of documents in a document stack;

rotating a drive roller to lift a trailing edge of a topmost document from the document stack;

moving the document stack from contact with the drive roller;

rotating the drive roller to cause the topmost document trailing edge to move between the drive roller and a diverter;

pivoting the diverter to capture the trailing edge of the topmost document between the drive roller and the diverter;

rotating the drive roller to transport the topmost document along the diverter; and guiding the topmost document along the diverter away from the document stack.

26. A method comprising:

pivoting a first flap downward from an initial position to tilt a document stack to create a gap between the document stack and a drive roller;

inserting a document into the gap;

rotating the first flap upward to capture the document between the drive roller and the document stack;

rotating a second flap downward to tilt the document stack to create a gap between the document stack and a diverter roller;

rotating the drive roller to transport the document so that a leading edge of the document rests on the second flap and a trailing edge of the document rests on the first flap; and rotating both the first and second flaps upward away from the document stack so that the leading and trailing edges of the document move past the flaps and rest on the document stack.

27. A method comprising:

rotating a first flap from an initial position to rotationally deflect a document stack thereby creating a gap between the document stack;

rotating a drive roller to lift a trailing edge of a topmost document from the document stack;

removing contact between the drive roller and the document stack while maintaining contact with the edge of the topmost document;

rotating the drive roller to move the topmost document trailing edge between the diverter and the drive roller;

pivoting the diverter to capture the topmost document edge between the diverter and the drive roller;

rotating the drive roller to move the topmost document along the diverter; and guiding the topmost document along the diverter away from the document stack.

* * * * *